United States Patent [19]

Hamisch, Jr.

[11] 4,173,184

[45] Nov. 6, 1979

[54] PRINT HEAD

[75] Inventor: Paul H. Hamisch, Jr., Franklin, Ohio

[73] Assignee: Monarch Marking Systems, Inc., Dayton, Ohio

[21] Appl. No.: 577,372

[22] Filed: May 14, 1975

[51] Int. Cl.[2] ..... B41J 1/20

[52] U.S. Cl. ..... 101/111

[58] Field of Search ..... 101/93.14, 111, 105, 101/93.13, 379, 380, 316

[56] References Cited

U.S. PATENT DOCUMENTS

| | | | |
|---|---|---|---|
| 1,069,868 | 8/1913 | Ellis | 101/111 |
| 1,558,869 | 10/1925 | Gulling et al. | 101/111 |
| 2,096,340 | 10/1937 | Richeson | 101/111 |
| 3,230,880 | 1/1966 | Beaver | 101/380 |
| 3,338,160 | 8/1967 | Heil | 101/111 X |
| 3,783,083 | 1/1974 | Jenkins | 161/38 |
| 3,783,788 | 1/1974 | Ellison et al. | 101/333 |
| 3,796,152 | 3/1974 | Finke et al. | 101/111 |
| 3,798,106 | 3/1974 | Jenkins et al. | 101/316 X |

FOREIGN PATENT DOCUMENTS

| | | | |
|---|---|---|---|
| 453767 | 6/1968 | Switzerland | 101/111 |

*Primary Examiner*—Edward M. Coven
*Attorney, Agent, or Firm*—Joseph J. Grass

[57] ABSTRACT

There is disclosed a print head having a print head frame, a plurality of drive wheels, a support, and a plurality of printing bands trained about the support and the respective wheels so that the selected printing elements can be presented at a printing zone. Each printing band has a plurality of different printing elements connected by hinges. The support has a pair of support members having respective elongated lands, and the lands have tapered entries and terminate at opposed generally parallel shoulders. Each printing band has spaced apart, generally flat, smooth lugs at its underside. The support shoulders are spaced apart by a distance approximately equal to the length of a lug. The support lands contact only the undersides of adjacent hinges while a printing element is at a printing zone. Each wheel has a plurality of notches to receive the lugs on the underside of the respective printing band. Each wheel notch has a pair of shoulders spaced apart by a distance substantially equal to the length of a lug. Each wheel has peripheral lands between the wheel notches for contacting hinges on the underside of the printing band. Each peripheral land has a peripheral dimension substantially equal to the spacing between adjacent lugs, and the wheel shoulders at each notch are generally parallel.

10 Claims, 7 Drawing Figures

PRINT HEAD

BACKGROUND OF THE INVENTION

1. Field of the Invention

This invention relates to the art of print heads.

2. Brief Description of the Prior Art

Typical print heads to which the invention can be applied are disclosed in U.S. Pat. No. 3,783,083 to W. A. Jenkins dated Jan. 1, 1974. Another prior art print head is disclosed in U.S. Pat. No. 3,783,786 to L. E. Ellison et al dated Jan. 8, 1974.

SUMMARY OF THE INVENTION

The invention relates to a print head having improved detenting of the printing band. According to a preferred embodiment, the print head includes at least one and preferably a plurality of drive wheels and respective printing bands. The bands, which are preferably of endless, unitary construction, are trained about the respective drive wheels and a preferably stationary support. Each printing band has a plurality of printing elements or blocks having different printing characters and are connected by hinges. The underside of the band has equally spaced apart lugs which are preferably flat, that is, of uniform thickness, and the undersides of the lugs are preferably smooth. The ends of each lug comprise generally parallel end faces. There is a lug at the underside of each printing element. The support has a pair of support members having respective elongated lands. The support lands have tapered entries and terminate at opposed generally parallel support shoulders. The support shoulders are spaced apart by a distance substantially equal to the length of a lug. Thus, each printing element which is located at the printing zone is actually "plugged in" by means of its respective lug fitting into a pocket or notch in the support. The support lands support only adjacent hinges at locations immediately adjacent the printing element at the printing zone. The support lands are of sufficient height so that the lug at the printing zone does not bottom in the support notch. Each wheel has a plurality of notches to receive lugs at the underside of the respective printing band. Each wheel notch has a pair of shoulders spaced apart by a distance substantially equal to the length of a lug. Each wheel has peripheral lands between the wheel notches. The wheel shoulders associated with each wheel notch are preferably generally parallel and the notches are sufficiently deep so that the lugs do not bottom in the wheel notches. It is apparent that the end faces of the lugs that are fully engaged with the wheel meet the wheel shoulders substantially squarely.

DESCRIPTION OF THE PREFERRED EMBODIMENTS

Figures 1, 2, 3, 4, 5, 6, 7:
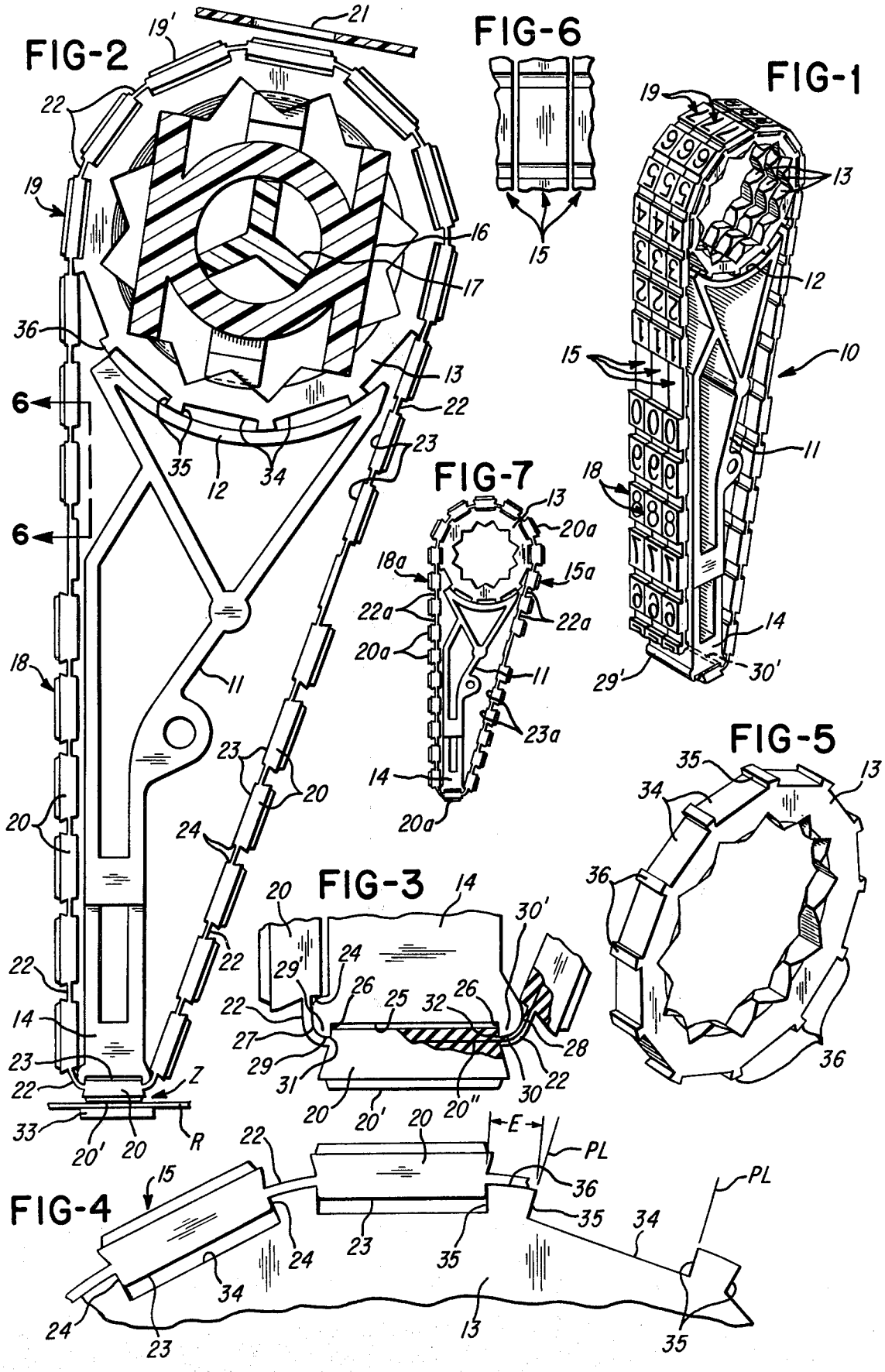
FIG. 1 is a perspective view of a fragmentary portion of a print head in accordance with the invention.
FIG. 2 is an enlarged side elevational view of the print head shown in FIG. 1.
FIG. 3 is an enlarged side elevational view showing the manner in which a printing element of a printing band is supported by a support at the printing zone.
FIG. 4 is an enlarged fragmentary view showing a portion of a drive wheel and a portion of the printing band.
FIG. 5 is a perspective view of the wheel.
FIG. 6 is a fragmentary view taken along line 6—6 of FIG. 2.
FIG. 7 is a side elevational view of an alternative embodiment.

With reference to FIG. 1, there is shown a fragmentary portion of a print head generally indicated at 10. The print head 10 includes a print head body or frame 11 having a transversely extending arcuate portion or saddle 12 in which wheels 13 are rotatably mounted. The body 11 includes a support 14. Printing bands generally indicated at 15 are trained or received about the support 14 and the respective wheels 13 so that each printing band 15 is capable of being driven by its respective drive wheel 13. A selector 16 rotatably mounted on a shaft 17 can be coupled with one wheel 13 at a time so that the wheels 13 can be selectively driven and consequently the selected printing band 15 is rotated about the support 14 the selected distance. The printing bands 15 are under slight tension. Each printing band 15 has a printing section 18 and a corresponding human readable non-printing section 19 so that when a selected printing element 20 is disposed at the printing zone Z as shown in FIG. 2, then a corresponding human readable character can be sighted through a window 21. Hinges 22 connect adjacent printing blocks or elements 20. The underside of both the printing and human readable sections 18 and 19 are provided with lugs 23. The lugs 23 preferably are generally flat and smooth on their undersides and terminate at opposed ends at generally parallel end faces 24. Each of the lugs 23 has the same length and lugs 13 are equally spaced apart. Reinforcing material such as nylon cords 20'' are shown to pass through the printing elements 20 and the hinges 22 of each individual band 15. The bands 15 are molded with elastomeric material. Each band 15 can yield resiliently as it is advanced upon rotation of wheel 13. The support 14 has a transversely extending notch or pocket 25 for receiving a lug 23 of each printing band 15 at the printing zone Z. The notch 25 has a pair of opposed shoulders 26 which are generally parallel to each other. The shoulders 26 are spaced apart by a distance approximately equal to the length of a lug 23 before the lug 23 is received in the socket 25. The lugs 23 are preferably slightly longer, for example 0.001 inch, than the distance between the shoulders 26 so that there is a slight interference fit therebetween. When a printing element 20 is at the printing zone there is one and only one location and orientation for that printing element 20 which is in effect "plugged in" by means of its respective lug 23 to the notch 25. Thus, in moving the printing band 15 to the selected position, there is no tendency whatever for the printing band to creep partly out of the pocket or notch 25 into which it snaps. As best shown in FIG. 3, the support 14 has opposed tapered entries 27 and 28 and lands 29 and 30 formed on support members 29' and 30' which terminate at the respective shoulders 26. The lands 29 and 30 support the hinges 22 at each side of the printing element 20 which is disposed at the printing zone Z. The arrangement of the support shoulders 26, the end faces 24, and the support that lands 29 and 30 provide to the hinges 22 results in excellent detenting of the printing bands 15 so that each selected printing element 20 is properly registered at the printing zone Z. The land 29 and 30 are slightly radiussed at 31 and 32 where they join the shoulders 26. Accordingly, the printing characters 20' of the respective printing elements 20 are capable of making a quality printing impression on a record R disposed on a platen 33 when the print head 10 and the platen 33 move into cooperation with each other. With reference to FIG. 4, the wheel 13 is shown to have spaced apart notches or channels 34. Notches 34 have spaced apart shoulders 35. It is preferred that the shoulders 35 of each notch 34 be generally parallel to each other and that they be spaced apart by a distance substantially equal to the length of the respective lugs 33. Accordingly, the end faces 24 of the printing bands 15 abut the shoulders 35 of the wheels 13 essentially squarely. In addition, peripheral extent E of arcuate lands 36 between adjacent notches 34 is approximately equal to the length of the respective hinges 22. As best shown by extension lines PL in FIG. 4, the shoulders 35 are generally parallel to each other. The lugs 23 are spaced from the bottoms of the respective notches 34. The human readable characters 19' and printing elements 20 can extend along chords of the circle defined by its wheel 13. Therefore, any printing elements 20 disposed at the wheel 13 cannot acquire a predetermined curvature. The flexure in the band 15 takes place at the hinges 22. The hinges 22 are relatively thin as compared with the combined thickness of the printing element 20 and its associated lug 23.

The embodiment of FIG. 7 is identical to the embodiment of FIGS. 1 through 6, except that the bands **15*a* has only a printing section 18*a* but no human readable section. The printing section 18*a* extends for substantially the entire length of the band 15*a*. It is apparent that because of the configuration of the wheel 13, all the bending takes place in hinges 22*a*. Hence the printing elements 20*a* disposed at the wheel cannot acquire a predetermined curvature. The hinges 22*a* are also relatively thin as compared with the combined thickness of a printing element 20*a* and its associated lug 23*a***.

In the above embodiments, the lugs 23 and **23*a* are about 0.145 inch in length, and the lugs 23 and 23*a* are about 0.01 inch thick measured from the undersides of the hinges and preferably less than about 0.02 inch thick. Lugs 23 and 23*a*** are spaced apart about 0.062 inch.

Further details of the selector 16 and wheels 13 are disclosed in above mentioned U.S. Pat. No. 3,783,083.

Other embodiments and modifications of this invention will suggest themselves to those skilled in the art, and all such of these as come within the spirit of this invention are included within its scope as best defined by the appended claims.

I claim:

1. A print head, comprising: a frame having a stationary support, a plurality of rotatable wheels mounted by the frame, a plurality of printing bands received under tension about the support and the respective wheels, each printing band having a plurality of different printing elements and hinges connecting the printing elements, and spaced apart, smooth lugs on the undersides of the printing bands and there being a sufficient number of lugs at the underside of each band to enable any selected printing element to be brought to a printing zone by rotation of the respective wheel, there being a lug at the underside of each printing element, the lugs being of substantially equal length and each lug terminating at generally parallel end faces, the support including a notch and a pair of support members having respective elongated lands, the lands having tapered entries and terminating at opposed shoulders which define the ends of the support notch, the support shoulders being generally parallel, the support lands being spaced apart to support only two adjacent hinges of a printing element while the intervening lug is received in the support notch between the support shoulders, the support notch being deeper than the lug thickness, the end faces of the lug at the printing zone contacting the support shoulders, each wheel having a plurality of notches to receive the lugs, each wheel notch having a pair of shoulders spaced apart by a distance substantially equal to the length of a lug, each wheel having peripheral lands between the wheel notches for supporting only the hinges, each peripheral land having a peripheral dimension substantially equal to the spacing between adjacent lugs, the wheel shoulders being generally parallel, the wheel notches being deeper than the lug thickness.

2. A print head as defined in claim 1, wherein the lugs are less than about 0.02 inch thick.

3. A print head as defined in claim 1, wherein the lugs are about 0.01 inch thick and about 0.145 inch in length.

4. A print head as defined in claim 1, wherein the lugs are less than about 0.02 inch thick, are about 0.145 inch in length, and are spaced apart by about 0.06 inch.

5. A print head, comprising: a frame having a stationary support, a wheel mounted by the frame, a printing band received under tension about the support and the wheel, the printing band having a plurality of different printing elements and hinges connecting the printing elements, and spaced apart, smooth lugs on the underside of the printing band and there being a sufficient number of lugs at the underside of the band to enable any selected printing element to be brought to a printing zone by rotation of the wheel, there being a lug at the underside of each printing element, the lugs being of substantially equal length and each lug terminating at generally parallel end faces, the support including a notch and a pair of support members having respective lands, the lands having tapered entries and terminating at opposed shoulders which define the ends of the support notch, the support shoulders being generally parallel, the support lands being spaced apart to support only two adjacent hinges of a printing element while the intervening lug is received in the support notch between the support shoulders, the support notch being deeper than the lug thickness, the end faces of the lug at the printing zone contacting the support shoulders, the wheel having a plurality of notches to receive lugs at the underside of the printing band, the wheel notches having a pair of shoulders spaced apart by a distance substantially equal to the length of a lug, each wheel having peripheral lands between the wheel notches for supporting only the hinges, each peripheral land having a peripheral dimension substantially equal to the spacing between adjacent lugs, the wheel shoulders being generally parallel, the wheel notches being deeper than the lug thickness.

6. A print head as defined in claim 5, wherein the lugs are less than about 0.02 inch thick.

7. A print head as defined in claim 5, wherein the lugs are about 0.01 inch thick and about 0.145 inch in length.

8. A print head as defined in claim 5, wherein the lugs are less than about 0.02 inch thick, are about 0.145 inch in length, and are spaced apart by about 0.60 inch.

9. A print head, comprising: a frame having a stationary support, a wheel mounted by the frame, a printing band received under tension about the support and the wheel, the printing band having a plurality of different printing elements and hinges connecting the printing elements, and spaced apart, smooth lugs on the underside of the printing band and there being a sufficient number of lugs at the underside of the band to enable any selected printing element to be brought to a printing zone by rotation of the wheel, there being a lug at the underside of each printing element, the lugs being of substantially equal length and each lug terminating at generally parallel end faces, the support including a notch and a pair of support members having respective lands, the lands having tapered entries and terminating at opposed shoulders which define the ends of the support notch, the support shoulders being generally parallel, the support lands being spaced apart for supporting only two adjacent hinges of a printing element while the intervening lug is received in the support notch between the support shoulders, the support notch being deeper than the lug thickness, the end faces of the lug at the printing zone contacting the support shoulders, the wheel having a plurality of notches to receive lugs at the underside of the printing band.

10. A print head, comprising: a frame having a stationary support, a plurality of rotatable wheels mounted by the frame, a plurality of printing bands received under tension about the support and the respective wheels, each printing band having a plurality of different printing elements and hinges connecting the printing elements, and spaced apart, smooth lugs on the undersides of the printing bands and there being a sufficient number of lugs at the underside of each band to enable any selected printing element to be brought to a printing zone by rotation of the respective wheel, there being a lug at the underside of each printing element, the lugs being less than about 0.02 inch thick, the lugs being of substantially equal length and each lug terminating at end faces, the support including a notch and a pair of support members having respective elongated lands, the lands having tapered entries and terminating at opposed shoulders which define the ends of the support notch, the support lands being spaced apart to support only two adjacent hinges of a printing element while the intervening lug is received in the support notch between the support shoulders, the support notch being deeper than the lug thickness, the end faces of the lug at the printing zone contacting the support shoulders, each wheel having a plurality of notches to receive the lugs, each wheel notch having a pair of shoulders spaced apart by a distance substantially equal to the length of a lug, each wheel having peripheral lands between the wheel notches for supporting only the hinges, each peripheral land having a peripheral dimension substantially equal to the spacing between adjacent lugs, the wheel notches being deeper than the lug thickness.

* * * * *